US005123223A

United States Patent [19]

Makarevich et al.

[11] Patent Number: 5,123,223

[45] Date of Patent: Jun. 23, 1992

[54] DECORATIVE ATTACHMENT FOR A DOOR

[75] Inventors: Justine D. Makarevich, 36 Bryson Mill Rd., New Castle, Pa. 16101; Wallace London, Baltimore, Md.

[73] Assignee: Justine D. Makarevich, New Castle, Pa.

[21] Appl. No.: 578,789

[22] Filed: Sep. 7, 1990

[51] Int. Cl.[5] ..... E06B 1/34

[52] U.S. Cl. ..... 52/311; 40/591; 206/325; 52/314

[58] Field of Search ..... 52/311, 314, DIG. 12, 52/511, 515; 206/325, 449, 453; 40/591

[56] References Cited

U.S. PATENT DOCUMENTS

| | | | |
|---|---|---|---|
| 2,489,029 | 11/1949 | Guerrant | 206/325 |
| 2,742,146 | 4/1956 | Lester, Jr. | 206/325 |
| 3,255,542 | 6/1966 | Vane | 40/591 |
| 3,461,584 | 8/1969 | Wilson | 40/591 |

OTHER PUBLICATIONS

L. L. Bean, Inc., "Home and Camp Specialties" Catalog, cover page and p. 71 (Fall 1991).

*Primary Examiner*—David A. Scherbel
*Assistant Examiner*—Wynn E. Wood
*Attorney, Agent, or Firm*—Mason, Fenwick & Lawrence

[57] ABSTRACT

A door and decorative attachment therefor comprises a sheet covering all or a portion of the surface of a door, and having linear elements or pockets for readily and releasably holding the sheet to the door. The sheet may have visual elements, such as objects or scenes thereon, as by pasting, gluing, printing or weaving, and may have a support permanently or detachably secured to the sheet, for supporting an object such as wreath. The sheet may have a hole in registry with, for example, a handle, which extends through the hole.

20 Claims, 1 Drawing Sheet

DECORATIVE ATTACHMENT FOR A DOOR

FIELD OF THE INVENTION

The present invention relates to a door and a decorative attachment for the door.

BACKGROUND OF THE INVENTION

A wide spread custom is the decorating of doors, particularly during various holiday seasons. The doors which are decorated are entrance doors into homes and apartments, and doors for rooms within homes and in offices. These decorations are applied in order enhance the celebration of the holiday, decorations being frequently applied at Halloween, Thanksgiving and during the Christmas-New Year season.

These door decorations were traditionally such objects as corn husks and wreaths which were attached to the exterior of entrance doors to homes, and paper covering of various kinds for a face of a door. Such paper coverings include, for example, sheets of paper attached to a face of the door by adhesive tape, the paper being printed with scenes appropriate to the season, or printed with fancy designs as used for wrapping. Individual decorators sometimes paste silhouette figures or paint or color representation of appropriate persons or articles to the paper covering.

Where wreathes or corn husks were attached to the door, this was frequently done by a nail which penetrated into the door, marring its appearance when the decorative object and the nail were withdrawn, and in the case of an exterior door, breaking the water impervious coating on the face of the door.

The door coverings which were applied so as to cover an entire face of the door, and secured by adhesive tape, were time consuming; persons, including the staff of businesses, often expend a substantial amount of time in applying the paper covering, and in the other ornamentation which their imagination and skills dictated. In addition, a substantial amount of time was consumed in removing and discarding the decorative paper covering, leaving the entire process to be repeated at the next season, with attendant expense and consumption of time.

SUMMARY OF THE INVENTION

The present invention is directed to a door and a decorative attachment for the door, the decorative attachment comprising a sheet of material, preferably cloth or paper, which covers all or a substantial portion of a face of the door, this sheet being provided with elements to hold it on the door, which permit the sheet to be readily removed from the door The releasable holding devices may take any of a number of forms, including one or more elastic loops or a plurality of pockets provided at the corners of the doors. The pockets may have elastic elements, or a pair of the pockets may be joined by an elastic strip o band. Other forms of non-penetrating and non-attaching releasable constructions usable as part of the present invention are linearly extending elements, such as loops, particularly elastic loops, which are attached to the sheet and which can extend over the corners of the door.

The sheet may have on it a support for a decorative element, such as wreath, the support being in the form of a hook secured to the sheet in a permanent manner, as by a permanent adhesive, or may be releasably attached to the sheet, as by a releasable adhesive coating. Further, the sheet may be provided with decorative elements printed or pasted thereon, or woven into the fabric, where a woven textile fabric is utilized as the material of the sheet. The sheet may cover the entire face of a door, in which case it may be provided with a hole for any discontinuity on or in the door such as a peephole or a door handle, or there may be provided weakened lines permitting a portion of the sheet to be removed, leaving a hole. In either case, the hole will be in registry with the discontinuity, that is, with such elements as a peephole and a door handle.

DESCRIPTION OF THE PREFERRED EMBODIMENTS

Figure 1:
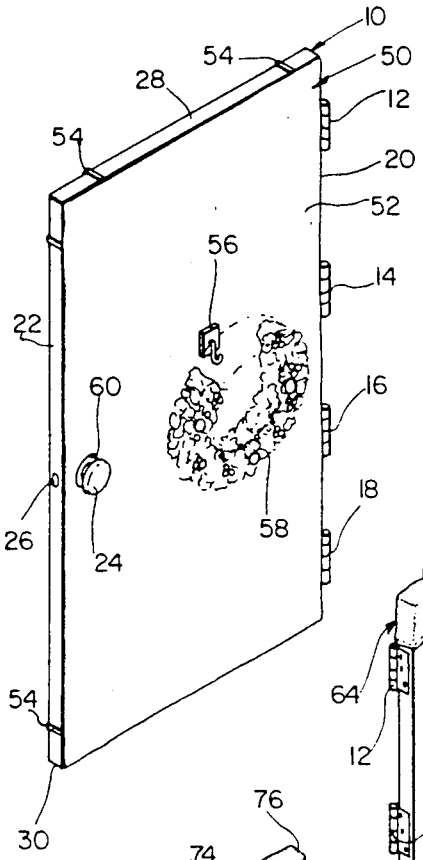
FIG. 1 is a perspective view of a door and decorative attachment therefor in accordance with the present invention.

Referring now to the drawings, wherein like or corresponding reference numerals are used for like or corresponding parts throughout the several views, there is shown in FIG. 1 a door 10 which is of standard construction, being rectangular, having hinges 12, 14, 16 and 18 at one edge 20 thereof, the opposite edge 22 of which has a discontinuity, specifically a door handle 24 adjacent to it, there being shown a latch bolt 26 which is operated by the handle 24 in conventional manner. There also is shown the top edge 28 and the bottom edge 30. The edges 20, 22, 28 and 30 bound the opposite spaced vertical faces of the door 10 which, in conventional manner, extend between the edges. The hinges 12, 14, 16, 18 support the door for swinging movement about a vertical axis which is adjacent to the vertical longitudinal edge 20 of the door 10.

A decorative attachment 50 is shown in FIG. 1, and comprises a sheet 52 which extends over substantially one entire face of the door, that face being as shown in FIG. 1, completely covered by the sheet 52. The sheet 52 may be made of any of a number of different materials, which in the preferred embodiment are flaccid, so that the attachment 50 may be removed, stored in a compact manner, and re-used at the next season. The material of sheet 52 may comprise paper, vinyl or textile. It may be printed, dyed or otherwise have visual decorative elements: alternatively, the sheet 52 may be of uniform color and texture.

The decorative attachment 50 further comprises loops 54 made of linearly extending elements which have their ends attached to the sheet 52, and which have portions which engage the face of the door which is opposite to that which is covered by the sheet 52. One or more of the loops 54 may be elastic.

A support 56, in the form of a hook, is permanently secured to the sheet 52, extending outwardly therefrom, and a decorative wreath 58, parts of which are shown broken away, is supported by the hook 56. As will be understood, hook 56 may be attached to the sheet 52 by bonding, by a releasable adhesive, or by other suitable means.

In order to provide access to the handle 24, the sheet 52 has a hole 60 in registry with the discontinuity of the door 10 provided by the handle 24.

The decorative attachment 50 is able to be folded for storage, with the support 56 in place or removed from it. It may be readily placed in position on the door 10 by manipulation of the loops 54, by placing them over the corners of the door 10 and passing the hole 60 over the door handle 24. The hole 60 may be provided in the sheet 52 as manufactured, or may be defined by weakened lines separating the sheet 52 from the portion thereof removed later to provide the hole 60. As will be apparent, where a door is to be decorated which does not have a handle, such as so-called "swinging doors", the sheet 52 will not have a hole, but may have weakened lines, so that the decorative attachment 50 may be used either on a swinging door without a handle or a door 10, as shown in FIG. 1.

Figure 2:
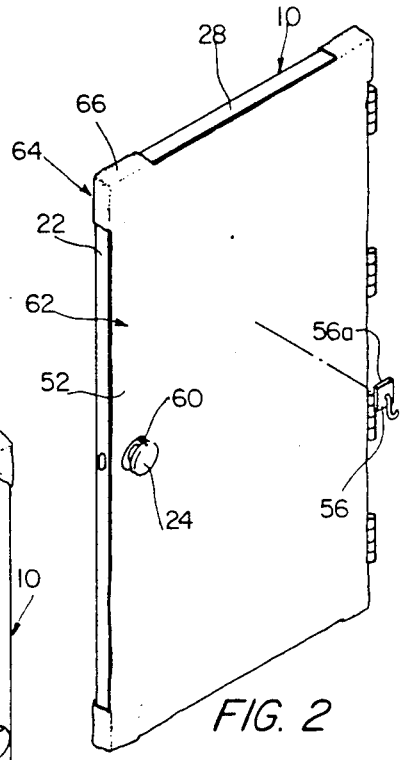
FIG. 2 is a perspective view of a door with an alternate embodiment of the decorative attachment in accordance with the present invention.
Figure 3:
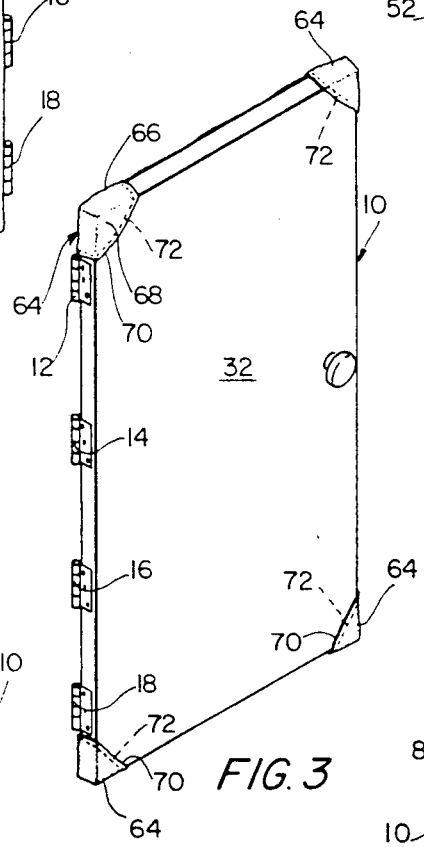
FIG. 3 is a rear view of the door and decorative attachment shown in FIG. 2.

In FIGS. 2 and 3, there is shown a door 10 and a decorative attachment 62 comprising a sheet 52 having pockets 64 at the corners thereof. These pockets 64 are formed by connecting portion 66, extending over two of the edges of the door 10, such as the edges 22 and 28, and as shown in FIG. 3, the connecting portion 66 being integral with a portion 68 on the face 32 of the door 10, which is the face opposite to that which is substantially covered by the sheet 52.

Referring again to FIG. 2, the sheet 52 will be seen to be provided with a hole 60 for the handle 24. The support 56, shown spaced from the sheet 52, is provided with a releasable adhesive layer 56*a*. Thus, the support 56 may be releasably adhered to the sheet 52. As shown in FIG. 3, one or more of the pockets 64 has a diagonally extending edge 70 of the portion 68, in which is an elastic element 72, permitting elongation of the length of the diagonal edge 70 which, together with shirring of the material of the pocket 64, particularly the connecting portion 66 and portion 68, enables the pocket 64 to be stretched so as to be placed over the corner of the door 10. Preferably, all four pockets 64 are provided with the elastic element 72 and shirring, but fewer than four of the pockets 64 may be made in this manner.

Figure 4:
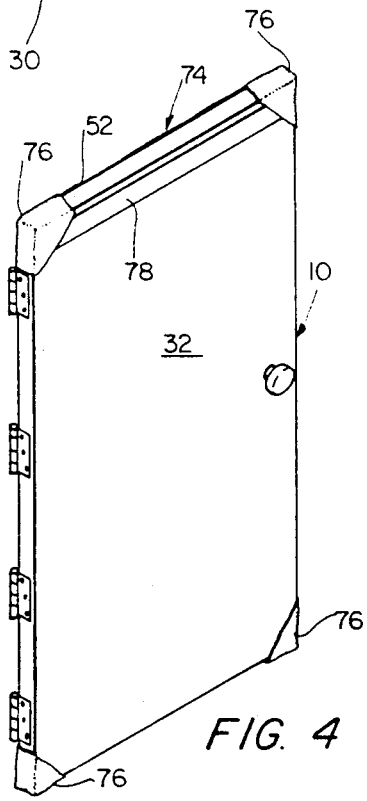
FIG. 4 is a perspective view of a door and another embodiment of a decorative attachment in accordance with the present invention.

In FIG. 4, there is shown an alternate construction in which a decorative attachment 74 is provided, including a sheet 52, the upper edge of which i shown in FIG. 4. There are also provided pockets 76 at each of the corners of the door 10. Extending between two of the pockets 76, such as the two upper pockets 76, there is an elastic band or strap 78. The decorative attachment 74 may be readily applied to the door 10 by first engaging the door with the two lower pockets 76, and then placing the upper two pockets 76 over the upper corners of the door 10, the elastic band 78 serving to assist in holding the pockets to which it is connected securely on the door 10. As will be understood, the flaccidity of the material of the pockets 76 will enable them to be manipulated over the corner of the door 10. The decorative attachment 74 could have the strap 78 along the lower edge of the door 10, and the elastic strap 78 may extend between two other pockets than those located at the top or at the bottom of the door 10.

Figure 5:
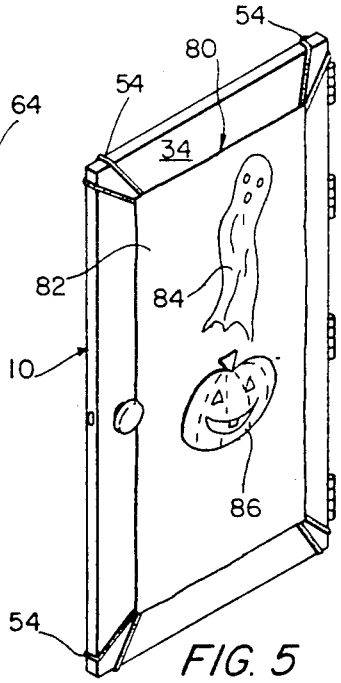
FIG. 5 is a perspective view of a door with an alternate embodiment of a decorative attachment in accordance with the present invention.

In FIG. 5, there is shown an alternate embodiment in which on the door 10 there is a decorative attachment 80 comprising a sheet 82 extending over substantially less than the entire face 34 of the door 10. By way of illustration, the sheet 82 is rectangular, having vertical and horizontal edges of lesser length than the vertical and horizontal edges of the door 10. There are provided on the sheet 82 linearly extending straps 54, one or more of which may be elastic and portions of which engage the face of the door 10 which is opposite to the face 34.

Shown on the sheet 82 are visual elements 84, 86, which may be cutouts adhered to the surface of sheet 82, or printed or painted thereon, or woven into the sheet 82, where sheet 82 is a woven textile. As illustrated, the decorative attachment 80 does not have a support 56, as in FIGS. 1 and 2, although it will be appreciated that the sheet 82 may be provided with such a support. Also, as will be appreciated, the sheet 52 may be provided with visual elements, such as visual elements 84 and 86 of sheet 82.

The sheet 82 may have different decorations on its opposite faces, which may be for different seasons or holidays, and may be held on the door with either face exposed. This aspect of the invention may also be applied to any embodiment in which the support 56 is not permanently secured.

There have been provided decorative attachments for application to a door which include a sheet which covers all of a face of a door or a substantial portion of a face of a door, the decorative attachment element including, also, attachment structures or elements which enable ready holding of the decorative attachment to a door without the use of adhesive tape or elements which would penetrate the door, particularly the opposed vertical surfaces 32 and 34 of the door. The decorative attachment may be provided with a permanently attached or temporarily adhered support for a decorative element such as wreath, and/or may be provided with visual elements, such as adhered, imprinted or woven objects, elements or scenes.

The decorative attachment herein provided may not only be readily applied to and removed from a door, but may be readily stored in a compact manner, due to the flaccid nature of the sheet forming a part thereof.

The claims and specification describe the invention presented, and the terms that are employed in the claims draw their meaning from the us of such terms in the specification. Some terms employed in the prior art may be broader in meaning than specifically employed herein. Whenever there is a question between the broader definition of such term as used in the prior art and the more specific use of the term herein, the more specific meaning is meant.

What is claimed is:

1. A decorative attachment for a door, the door being generally rectangular, having opposed vertical first and second faces in spaced relation, and supported for swinging movement about an axis adjacent to a vertical longitudinal edge thereof, said decorative attachment comprising:

a generally rectangular sheet extending over at least a substantial portion of the first face of the door, holding means for holding said sheet to the door, said holding means comprising at least one means defining a pocket at least one corner of said sheet, said pocket having a first portion thereof for engaging the second face of the door, and a second portion thereof extending between said sheet and said first portion for spacing said first portion from said sheet a distance approximately equal to the thickness of the door, whereby the corner of the door can be placed in said pocket, and a support for a decorative element on said sheet.

2. The combination of claim 1, said decorative element comprising visual elements on the exposed face of said sheet.

3. The combination of claim 1, said holding means comprising at least one elastic element.

4. The combination of claim 1, said holding means comprising a strap having first and second ends attached to said sheet and engaging the other face of said door.

5. The combination of claim 4, said strap being elastic.

6. The combination of claim 1, said sheet being rectangular and having four corners, said holding mean comprising a strap at each corner attached to said sheet and a portion of each said strap engaging the other face of said door.

7. The combination of claim 5, at least one of said straps being elastic.

8. The combination of claim 1, said holding means comprising linearly extending means attached to said sheet and engaging the other face of said door.

9. The combination of claim 1, wherein said first portion of said pocket has an edge including an elastic element.

10. The combination of claim 1, wherein said holding means comprise a said pocket at each corner of said door.

11. The combination of claim 1, said holding means further comprising a pair of said pockets, and an elastic strip extending between and connected to the pockets of said pair of pockets.

12. The combination of claim 11, and further comprising a second pair of pockets spaced from said first pair of pockets.

13. The combination of claim 1, said door having a knob extending from said one face, said sheet having a hole through which said knob extends.

14. The combination of claim 13, said hole having an edge defined as part of a line of weakening.

15. The combination of claim 1, said door having a discontinuity, said sheet having a hole therein in registry with said discontinuity.

16. The combination of claim 1, said sheet extending over substantially the entire said face of said door.

17. The combination of claim 1, said sheet extending over a portion only of said face of said door.

18. A decorative attachment for a door, the door being generally rectangular, having four corners, opposed first and second vertical faces in spaced relation, and four transverse faces connecting the edges of the first and second faces, and being supported for swinging movement about an axis adjacent to a vertical longitudinal edge thereof, said decorative attachment comprising:

a generally rectangular sheet extending over at least a substantial portion of the first face of the door, said sheet having four corners, an inner face for placement against the door, and an outer face for placement facing away from the door, securing means for contacting two contiguous transverse faces and the second vertical face of the door for securing each of said corners of said sheet to a corresponding corner of the door, and supporting means attached to said sheet for supporting a decorative element on said outer face of said sheet.

19. The attachment of claim 18, said securing means comprising a strap having first and second ends attached respectively at first and second mutually perpendicular edges of said sheet adjacent one of said corners of said sheet.

20. The attachment of claim 19, said strap being elastic.

* * * * *